United States Patent [19]

Capo

[11] Patent Number: 4,535,928

[45] Date of Patent: Aug. 20, 1985

[54] DUAL PURPOSE CARTON

[75] Inventor: James L. Capo, Middletown, Ohio

[73] Assignee: International Paper Company, New York, N.Y.

[21] Appl. No.: 548,251

[22] Filed: Nov. 2, 1983

[51] Int. Cl.[3] ..... B65D 85/28

[52] U.S. Cl. ..... 229/16 R; 206/224; 206/371; 206/602; 211/69.1; 229/15; 229/22; 229/27

[58] Field of Search ..... 206/214, 216, 224, 371, 206/443, 557, 602, 223, 820; 229/39 R, 41 R, 16 R, 15, 27, 41 B, 22, 8; 248/459; 211/69.1; D9/431–433

[56] References Cited

U.S. PATENT DOCUMENTS

| | | | |
|---|---|---|---|
| 928,423 | 7/1909 | Belson | 229/22 |
| 1,682,594 | 8/1928 | Benjamin . | |
| 1,899,241 | 2/1933 | Marr . | |
| 1,982,780 | 12/1934 | Behrens | 46/37 |
| 2,085,827 | 7/1937 | Perreton | 206/820 |
| 2,205,262 | 6/1940 | Hayes | 46/35 |
| 2,544,783 | 3/1951 | Freedman et al. | 40/126 |
| 2,550,417 | 4/1951 | Klein | 229/8 |
| 2,636,313 | 4/1953 | Shank | 229/8 |
| 2,723,488 | 11/1955 | Ringler | 46/11 |
| 3,044,211 | 7/1962 | Palm | 46/11 |
| 3,099,380 | 7/1963 | Nathan | 206/602 X |
| 3,365,114 | 1/1968 | Macchi | 229/38 |
| 3,403,839 | 10/1968 | Farquhar | 229/40 |
| 3,494,536 | 2/1970 | Henry | 229/39 |
| 3,581,974 | 6/1971 | Freeman | 229/39 |
| 3,610,511 | 10/1971 | Engdahl | 229/15 |
| 3,626,494 | 12/1971 | Levin | 229/15 |
| 3,640,380 | 2/1972 | Huffman | 206/4 |
| 3,684,157 | 8/1972 | Mendez | 229/16 |
| 3,739,975 | 6/1973 | Davidow | 229/8 |
| 3,768,720 | 10/1973 | Bundy | 229/15 |
| 3,866,814 | 2/1975 | Bissler | 229/8 |
| 4,002,237 | 1/1977 | Nichols | 206/371 |
| 4,084,015 | 4/1978 | Patterson | 428/9 |
| 4,201,331 | 5/1980 | Austin | 229/39 |
| 4,230,261 | 10/1980 | Austin | 229/52 |
| 4,301,614 | 11/1981 | Newton | 46/79 |
| 4,307,834 | 12/1981 | Roccaforte | 229/17 |
| 4,326,356 | 4/1982 | Mason | 46/154 |
| 4,341,341 | 7/1982 | Roccaforte | 229/39 |

FOREIGN PATENT DOCUMENTS

| | | | |
|---|---|---|---|
| 1145656 | 3/1969 | United Kingdom | 206/214 |

*Primary Examiner*—Allan N. Shoap
*Assistant Examiner*—Bryon Gehman
*Attorney, Agent, or Firm*—Richard J. Ancel

[57] ABSTRACT

A folded paperboard carton, which, after having been used for its original purpose such as packaging a foodstuff, may be separated into several components and the components then assembled to form a holder or caddy for pencils, crayons and the like. The blank from which the carton is formed is provided with suitable cut and perforated lines such that separation of the components of the caddy may be readily effected and the components of the caddy may be assembled without requiring any glue or separate fastener element.

14 Claims, 10 Drawing Figures

FIG. 2
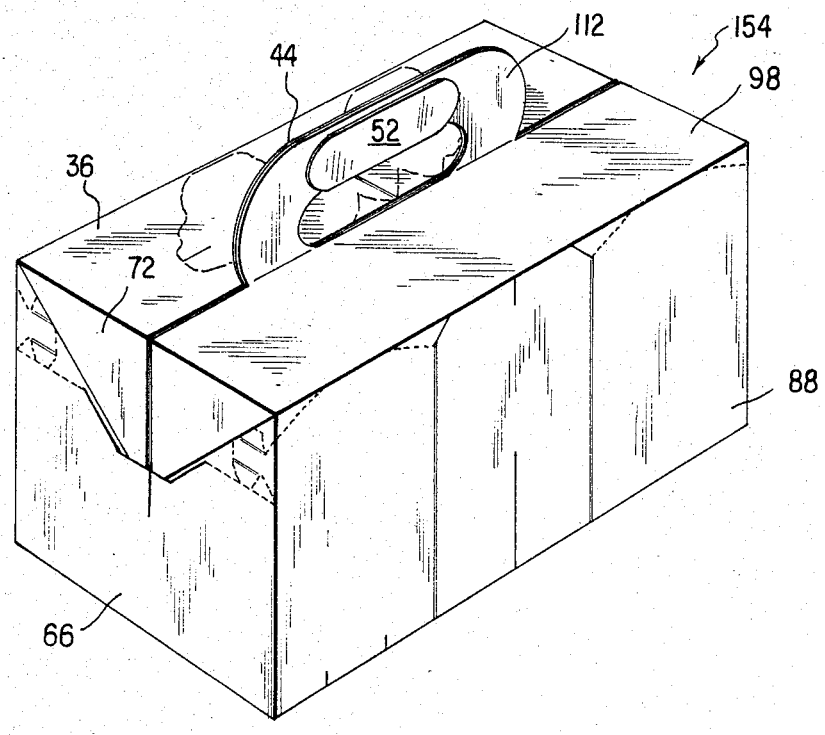
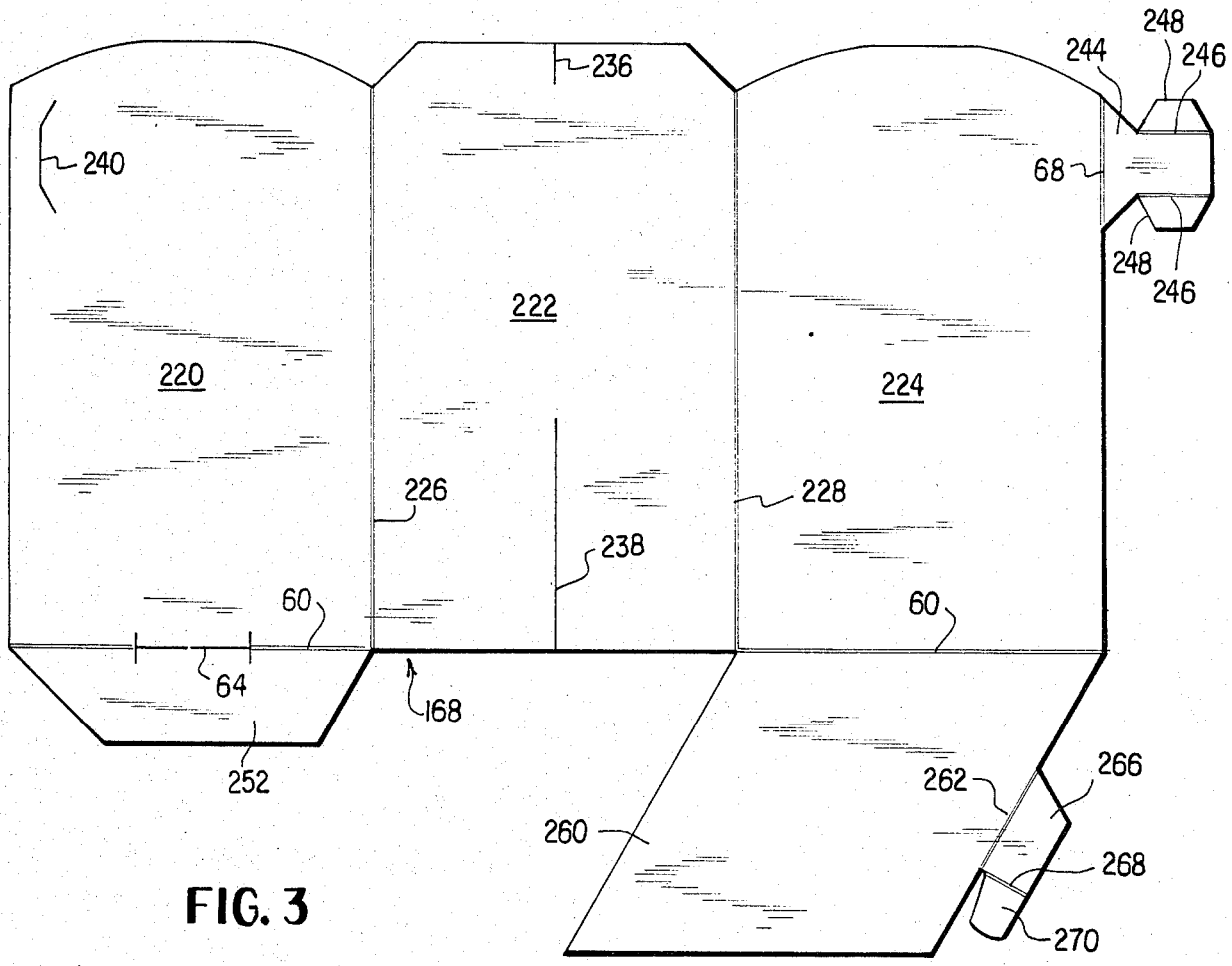
FIG. 3

DUAL PURPOSE CARTON

BACKGROUND OF THE INVENTION

This invention relates, in general, to cartons fashioned from paperboard or other stiff, resilient and foldable sheet material and more particularly to cartons wherein after being utilized, portions thereof may be employed or utilized for still further usage.

It is known to provide cartons which may be refolded from their original configuration, or capable of being at least partially dismembered and combined in a different manner after the initial intended usage. Such patents include U.S. Pat. Nos. 1,899,241 to Marr; 1,982,780 to Behrens; 2,723,488 to Ringler; 3,044,211 to Palm; 3,684,157 to Mendex; 4,301,614 to Newton; and 4,326,356 to Mason.

SUMMARY OF THE INVENTION

This invention particularly relates to a carton adapted for the packaging of fast food products, the carton having four separate panel cut-out elements which combine to form a novel holder or caddy for pencils, crayons and the like. The caddy includes two tubular bodies which are joined together by locking members, one of which may be in the form of a divider which extends into the two tubular bodies and further divides the same into compartments.

The full nature of the invention will be understood from the accompanying drawings and the following description and claims. It should be understood, however, that references in the following description to terms such as left, right, base, front, rear, and side wall members are for convenience of description, and such terms are not intended to be used in a limiting sense.

BRIEF DESCRIPTION OF THE DRAWINGS

FIG. 2 is a top perspective view of the carton formed from the blank of FIG. 1.

FIG. 3 is an enlarged plan view of a blank cut-out taken from the carton for a first tubular body which is formed from the carton.

DETAILED DESCRIPTION OF THE INVENTION

Figure 1:
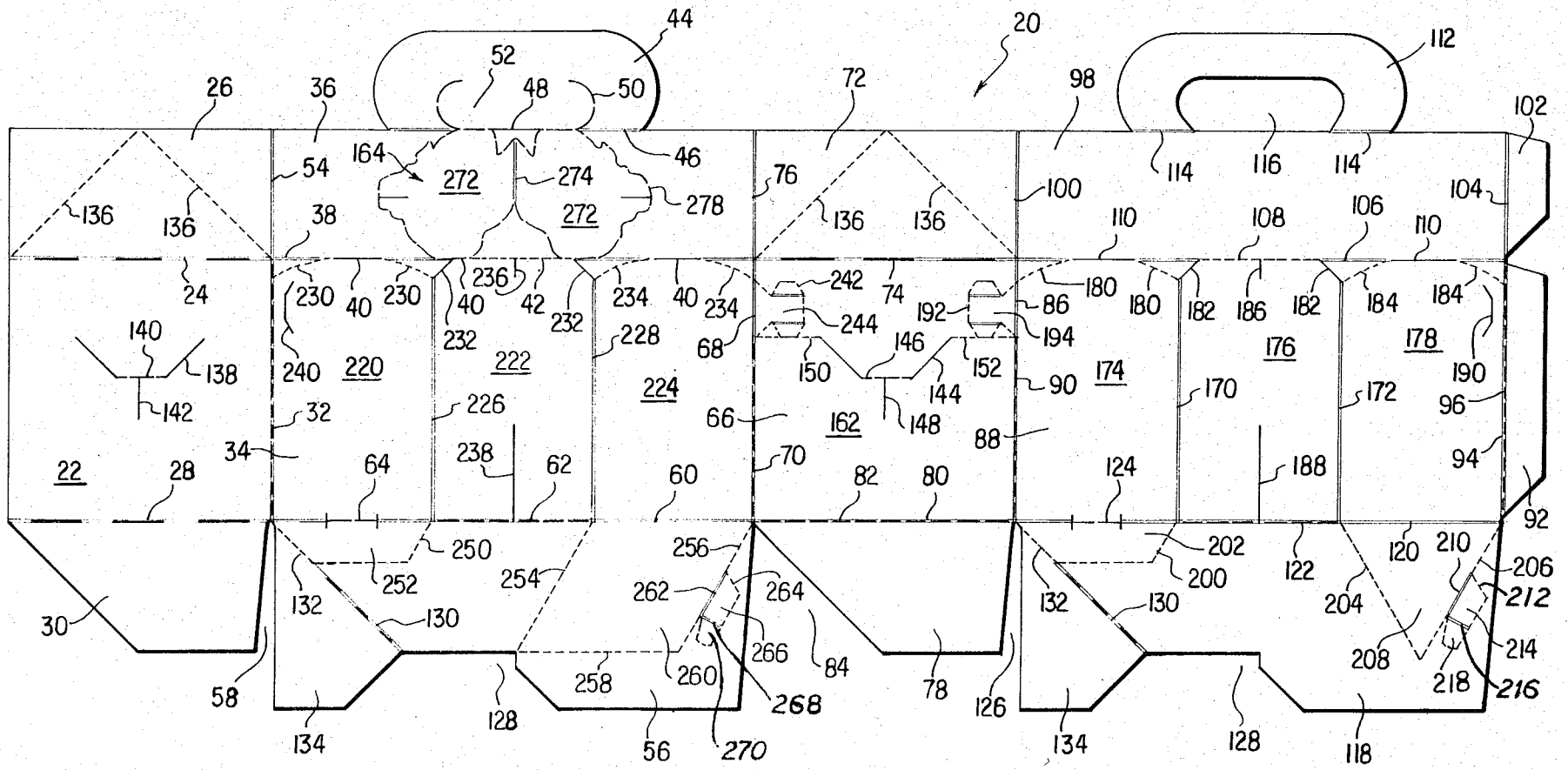
FIG. 1 is a plan view of a paperboard blank from which the carton in accordance with this invention is formed.

Referring now to FIG. 1, there is illustrated the blank for forming the carton which is the subject of this invention, the blank generally identified by the numeral 20. The blank 20 is preferably formed of paperboard and is generally rectangular in outline. The blank 20 includes an end panel 22 which has connected to the upper edge thereof, along a fold line 24, a top flap 26 and along a lower edge thereof, along a fold line 28, a bottom flap 30.

The end panel 22 is connected along a perforated fold line 32 to a side panel 34. The side panel 34 carries along its upper edge a top flap 36 which is connected thereto along a fold line 38 which is interrupted by cut lines 40 and a perforated line 42.

The top flap 36 carries a handle 44 which is connected to the top flap along a fold line 46 which is interrupted by a cut line 48 which is part of a generally C-shaped pair of cut lines 50 forming in the handle member 44 a foldable handle flap 52. The flaps 26 and 36 are separated by a fold line 54.

The body side panel 34 carries along the lower edge thereof a bottom flap 56. The bottom flap 56 is separated from the bottom flap 30 by a cut-out area 58 and is connected to the body side panel 34 along a fold line 60 which is in the central portion thereof interrupted by a series of cuts 62 and in the left portion thereof by cuts 64.

A second body end panel 66 is connected to the right edge of the body side panel 34 along a fold line 68 with the major portion thereof extending towards the bottom of the panels having formed therein cut lines 70. The body end panel 66 is of the same outline as the body end panel 22 and carries at the upper edge thereof a top flap 72 which corresponds to the top flap 26. The top flap 72 is connected to the body end panel 66 along a fold line 74 and is separated from the top flap 36 along a fold line 76.

The body end panel 66 carries at the lower edge thereof a bottom flap 78 which is connected to the body end panel 66 along a fold line 80 having formed therein a plurality of cuts 82. A bottom flap 78 is separated from the bottom flap 56 by a triangular cut-out 84.

The right edge of the body end panel 66 has connected thereto along a fold line 86 a body side panel 88 which is identical to the body side panel 34 in outline. The fold line 86 has cut line 90 incorporated in a major part thereof. The body side panel 88 carries along the right edge thereof a securing flap 92 which is connected thereto along a fold line 94 having incorporated therein a plurality of cuts 96.

The upper edge of the body side panel 88 carries a top flap 98 which is of the same outline as the top flap 36. The top flap 98 is separated from the top flap 72 by a fold line 100 and carries at the right edge thereof a connecting flap 102 which is secured thereto along a fold line 104. The top flap 98 is connected to the body side panel 88 along a fold line 106 which is interrupted in the central portion thereof by a series of perforations 108 and in the end portions thereof by elongated cut line 110.

The top flap 98 carries a handle member 112 which is connected to the top flap 98 along spaced fold lines 114 and has a central cut-out 116.

The body side panel 88 carries along its lower edge thereof a bottom flap 118 which is connected to the body side panel 88 along a fold line 120. A central part of the fold line 120 is provided with cuts 122 and a left part of the fold line 120 is interrupted by cuts 124. The bottom flap 118 is separated from the bottom flap 78 by a cut-out 126.

It is to be noted that the bottom flaps 56 and 118 are provided with like cut-outs 128 in the free edges thereof. Also, each of the bottom flaps 56, 118 is provided adjacent its companion bottom flap 30, 78 with a diagonal fold line 130 of which the upper portion is in the form of a perforated line 132. Each of the fold lines 130 defines a generally triangular flap portion 134.

Each of the top flaps 26, 72 is provided with a pair of upwardly converging perforated fold lines 136 to facilitate folding thereof in a manner to be described hereinafter.

Finally, the body end panel 22 has formed generally in the central portion thereof a channel shaped cut line 138 of which a central portion 140 is interrupted. This cut line is intercepted at the bottom thereof by a vertical cut line 142. In a like manner, the body end panel 66 is provided a generally channel shaped cut line 144 of which a lower central portion is an interrupted cut line 146. Extending downwardly from the central part of the interrupted cut line 146 is a vertical cut line 148. Horizontal cut lines 150 and 152 extend in opposite directions from the three ends of the channel shaped cut line 144 and intercept the fold line 68, 86, respectively.

The blank 20 is assembled to form the carton 154 of FIG. 2 by folding the bottom flaps 30, 78 into underlying relation with respect to the body end panels 22, 66, respectively, and then folding the bottom flaps 56, 118 into underlying relation with respect to the body side panels 34, 88, respectively. The thus folded blank is then folded along the fold lines 32 and 86, after which the connecting flaps 92 and 102 are bonded to the body end panel 22 and the top flap 26, respectively. Further, the triangular portions 134 of the bottom flaps 56 and 118 are bonded to the bottom flaps 30, 78, respectively in underlying relation. At this time the carton 154 is complete and is in its folded state.

The folded carton may be readily opened at which time the bottom flaps 56, 118 interlock, and in conjunction with the bottom flaps 30, 78, form a complete product supporting bottom. After the product has been placed within the thus erected carton, the top flaps 36, 98 are folded into a common plane and the handle members 44, 112 are joined together as is shown in FIG. 2. The top flaps 26, 72 are then folded along their fold lines 136 to have a generally triangular outline and the tips thereof extend through the openings defined by the cut lines 138, 144 in the body end panels 22, 66 as is also shown in FIG. 2.

Figure 7:
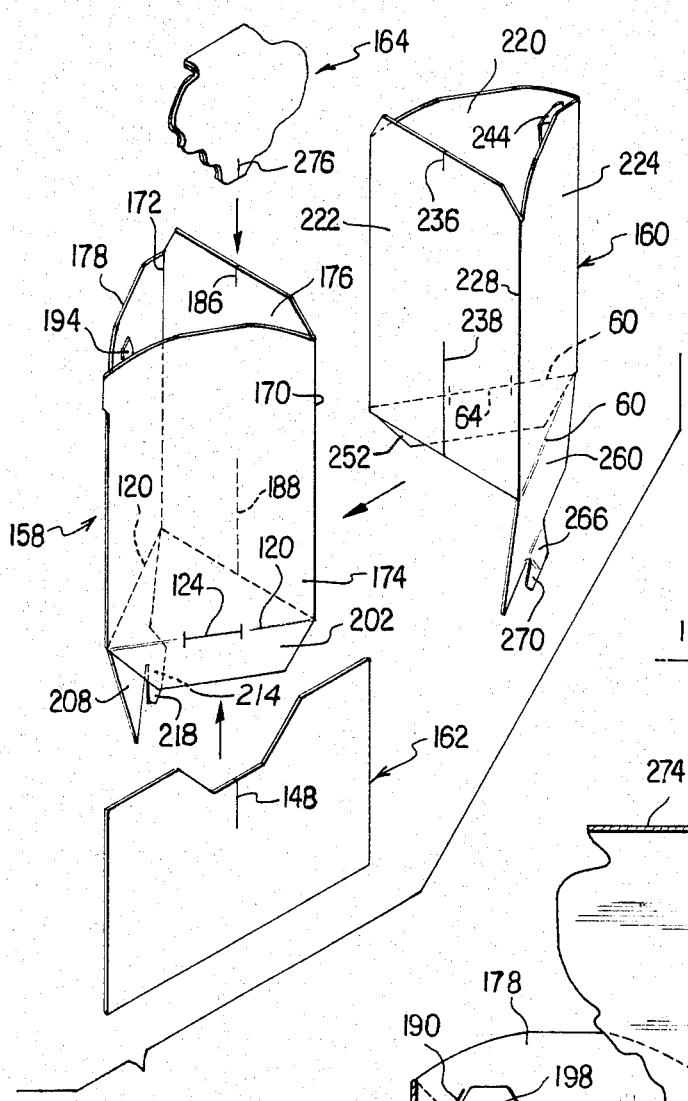
FIG. 7 is an exploded perspective view showing the components of the holder or caddy partially assembled.
Figure 8:
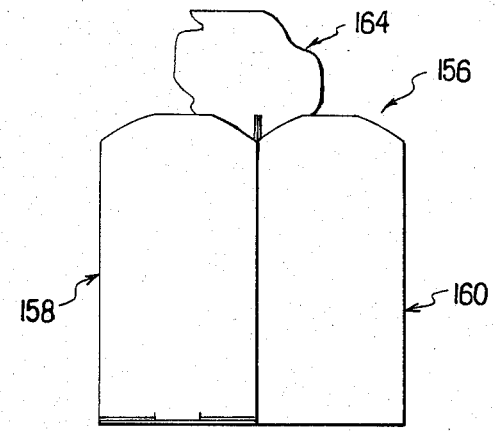
FIG. 8 is a side elevational view of the assembled caddy.
Figure 9:
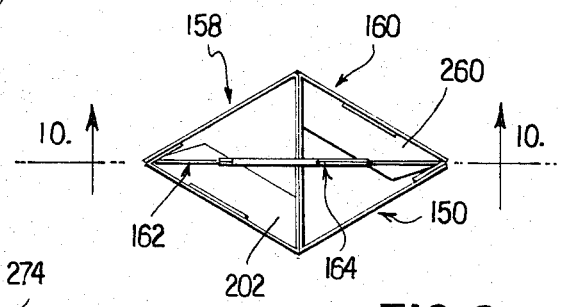
FIG. 9 is a top plan view of the assembled caddy.
Figure 10:
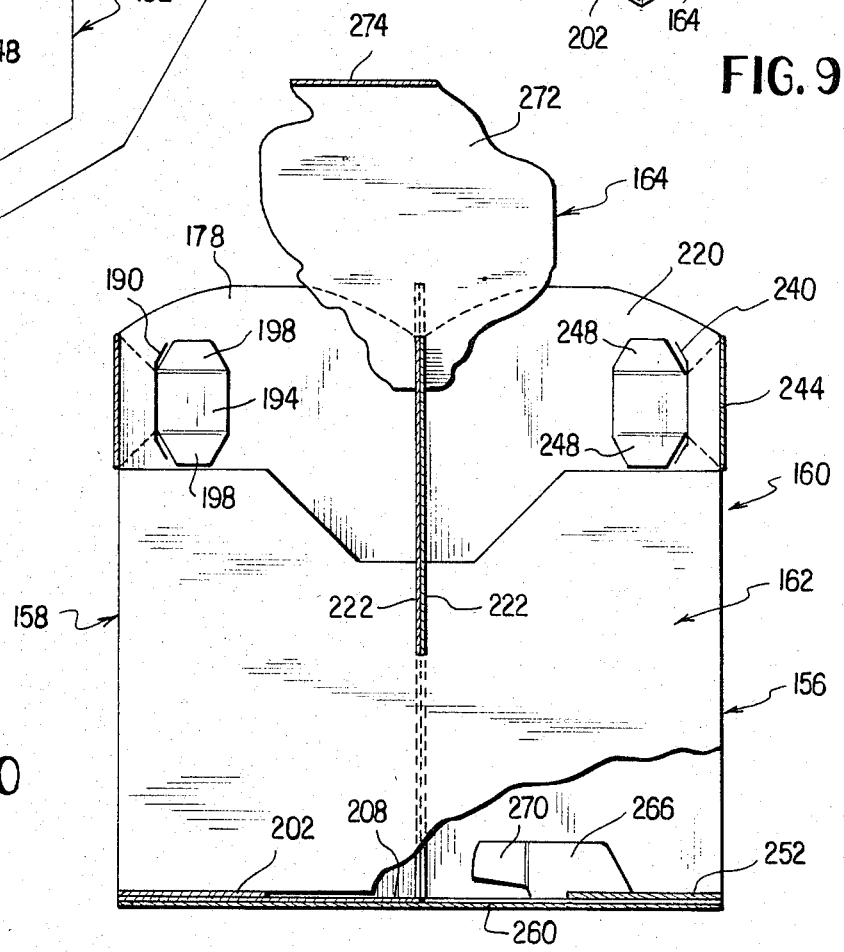
FIG. 10 is an enlarged vertical sectional view taken generally along the line 10—10 of FIG. 9 and shows the specific details of the caddy.

The thus described carton 154, after serving its original purpose, may then be disassembled and certain components thereof are utilized to form a caddy for pencils, crayons and the like. The caddy is generally identified by the numeral 156 and is best shown in FIGS. 8, 9 and 10. As is best shown in FIG. 7, the caddy 156 is formed in four parts which include tubular bodies 158, 160, a bottom combined divider and locking member 162 and a top locking member 164. The tubular body 158 shown in FIG. 7 is formed from a blank 166 shown in FIG. 4. The tubular member 160 shown in FIG. 7 is formed from blank 168 shown in FIG. 3. The details of the tubular blank 166 will be first discussed.

Referring once again to FIG. 1, it will be seen that the tubular blank 166 is formed from substantially all of the body side panel 88 and portions of the body end panel 66 and portions of the bottom flap 118. The body side panel 88 is provided with vertical fold lines 170, 172 which divide the body side panel 88 into panels 174, 176, and 178. At the top of the panel 174, the body side panel 88 is provided with a pair of perforated lines 180 which cooperate with the cut line 110 to define the upper edge of the panel 174. In a like manner, the body side panel 88 is provided at the top of the panel 176 with converging cut lines 182 which join the perforated line 108 and define the top edge of the panel 176. Finally, at the top of the panel 178, the body side panel 88 is provided with perforated lines 184, generally corresponding to the perforated lines 180, which join the other cut line 110 to define the upper edge of the panel 178.

A short cut line 186 is formed in the panel 176, at the top edge thereof. In the bottom of the panel 176 and in alignment with cut line 186 a relatively long cut line 188 is provided.

There is also provided in the panel 178 adjacent the connecting flap 96 a vertical, generally C-shaped cut line 190.

Figure 4:
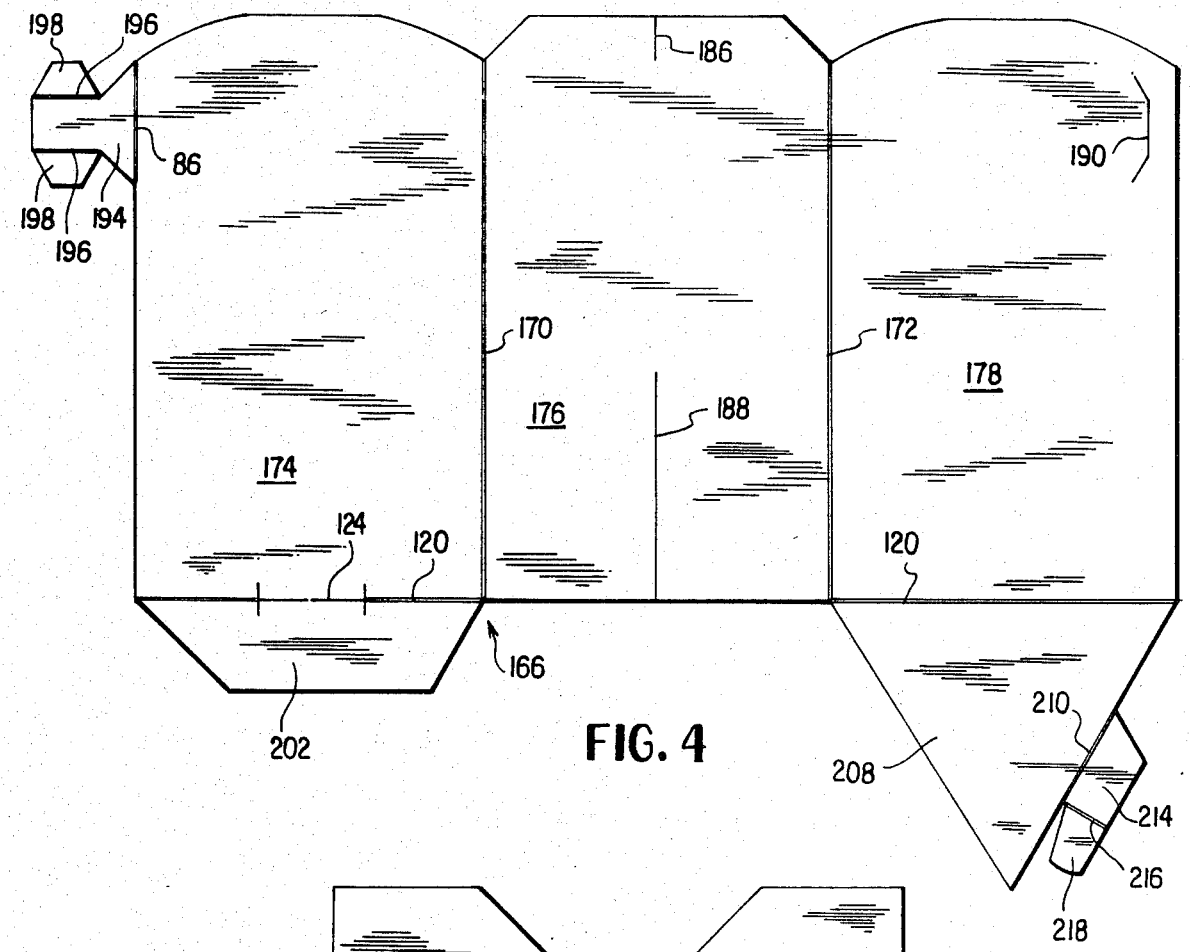
FIG. 4 is an enlarged plan view of a similar cut-out blank for a second tubular body also formed from the carton of FIG. 2.

The body end panel 66 is provided with a cut line arrangement 192 which define a projecting tab 194 connected to the panels 174 along the fold lines 86. As is best shown in FIG. 4, the tab 194 has formed therein a pair of parallel fold lines 196 which extend normal to the fold line 86 and defines a pair of locking ears 198.

It will also be seen that there is formed in the bottom panel 118 in association with the perforated fold line portion 132 a perforated line arrangement 200 which defines a bottom flap 202 which is connected to the lower edge of the panel 174 along the fold line 120.

The bottom flap 118, at the lower corner of the panel 178 is provided with converging perforated lines 204, 206 to define a triangular bottom flap 208 which is connected to the panel 178 along a portion of the fold line 120. The perforated line 206 is interrupted by a central fold line 210 and in association with the fold line 210 the bottom flap 118 is provided with a cut line arrangement 212 to define a locking tab 214 which is connected to the bottom flap 208 along the fold line 210. As is best shown in FIG. 4, the locking tab 214 is provided with a fold line 216 which extends normal to and is at one end of the fold line 210 so as to define a locking ear 218.

The blank 168 is primarily formed from substantially all of the body side panel 34. The body side panel 34 is divided into panels 220, 222 and 224 by vertical fold lines 226, 228. At the top of the panel 220 there are converging perforated lines 230 which in combination with the cut line 40 defines the top of the panel 220. At the top of the panel 222 there are converging cut lines 232 which in combination with the perforated line 42 define the top of the panel 222. Also, at the top of the panel 224 there are provided converging perforated lines 234 which in conjunction with the other of the cut lines 40 define the top of the panel 224. The body side panel 34 is also provided with a short vertical cut line 236 located centrally at the top of panel 222. A longer vertical fold line 238 is formed in the bottom of the body side panel 34 in alignment with the cut line 236.

The body side panel 34 is also provided adjacent to the fold line 32 in the upper left corner of the panel 220 with a vertical, generally C-shaped cut 240.

The body end panel 66 is provided adjacent the fold line 68 with a cut line arrangement 242 which defines a projecting locking tab 244 connected to the panel 224 along the fold line 68. As is best shown in FIG. 3, the locking tab 244 is provided with a pair of parallel fold lines 246 which are disposed normal to the fold lines 68 and form on the locking tab 244 a pair of locking ears 248.

At the bottom of the panel 220, the bottom flap 56 is provided with a perforated line 250 which, in conjunction with the perforated line 132, defines a bottom flap 252 on the panel 220. The bottom flap 56, in conjunction with the panel 224, is provided with a second perforated line including parallel perforated lines 254, 256 joined at their lower ends by a perforated line 258 which is parallel to the fold line 60. The perforated line 256 is interrupted by a central fold line 262 and the bottom flap 56 is provided with a further perforated line 264 which defines a locking tab 266 which is connected to the bottom flap 260 along the fold line 262. As is best shown in FIG. 3, the locking tab 266 is provided with a fold line 268 which is normal to the fold line 262 and at one end thereof to define a locking ear 270.

Figure 5:
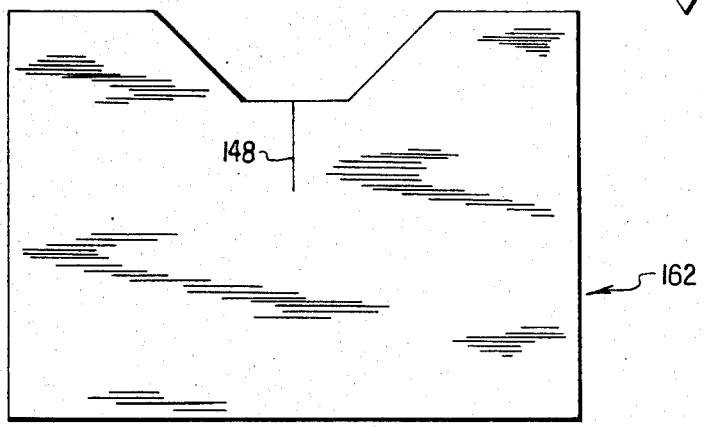
FIG. 5 is an enlarged plan view of a combined divider and locking member taken from the carton.

In comparing FIGS. 1 and 5, it will be seen that the combined divider and locking member 162 is formed from the lower part of the body end panel 66. It is formed by first tearing off the bottom flap 78 along the fold line 80 and then tearing up along the fold lines 70 and 90. The combined divider and locking member 162 is then removed from the body and panel 66 by tearing along the perforated lines 150, 152.

Figure 6:
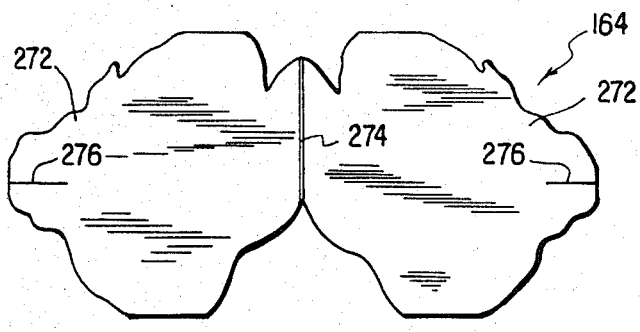
FIG. 6 is an enlarged plan view of a locking member also formed from the carton.

The locking member 164, as is best shown in FIG. 6, is formed of two halves 272 which are joined along a central fold line 274. Remote ends of the halves 272 are provided with aligned cut lines 276.

Referring once again to FIG. 1, it will be seen that the locking member 164 is formed from the top flap 36 and is defined by a continuous perforated line arrangement 278.

After the blanks 166 and 168, the combined divider and locking member 162 and the locking member 164 are removed from the carton, the caddy 156 may be assembled in a simple manner as is generally shown in FIG. 7.

The tubular body 158 is partially formed by folding the blank 166 along the fold lines 170, 172 and inserting the locking tab 194 through the C-shaped cut line 190 with the locking ears 198 engaging behind the panel 178 on the inner side thereof, as is shown in FIG. 7.

In a like manner, the body member 160 is formed by folding the blank 168 along the fold lines 226, 228 and inserting the locking tab 244 through the opening defined by the C-shaped cut line 240 with the locking ears 248 locking inwardly of and behind the panel 220.

With the tubular members 158, 160 partially assembled as shown in FIG. 7, the panels 176, 222 are brought into face to face relation and the combined divider and locking member 162 is inserted upwardly into the aligned cut lines or slit 188, 238 and with the cut line 148 further opening up to receive central portions of the panels 176, 222 to securely lock the tubular bodies 158, 160 together. Then bottom flaps 202 and 252 are folded. The bottom flap 260 is then folded along the fold line 60 in underlying relation to the bottom flap 252 and the locking tab 266 is passed through the opening defined by the cut line 64 with the locking ear 270 locking the locking tab 266 in place. Locking tab 214 is then passed through the opening defined by the cut line 124, and locking ear 218 is folded to lock the bottom flap 208 in place.

Assembly of the caddy 156 is now completed by folding the locking member 164 to its double thickness condition of FIG. 7 and passing it down through the aligned cut lines 186, 236 with the aligned cut lines 276 further engaging the panels 176, 222 to lock the tubular bodies 158, 160 together.

It is to be understood that the carton blank 29 will be suitably decorated so that the exposed portions of the tubular caddy bodies 158, 160 are also decorated. Further, it is to be understood that the configuration of the locking member 164 may be of any design which will enhance the appearance of the caddy.

The carton, which is preferably formed from the blank illustrated in FIG. 1, may be made from any suitable foldable material. Preferably, it is made of paperboard or the like, and a suitable paperboard stock, for example, is 0.016 SBS.

Generally speaking, the present invention is directed to a carton structure including body side and end panels, bottom flaps connected to the body side panels along fold lines, and at least one top flap. Each of the body side panels, at least one of the body end panels, each of the bottom flaps, and the one top flap all have lines of weakening therein for separating from the carton structure components of a caddy for pencils, crayons and the like. The caddy includes two tubular bodies each formed from one of the body side panels, and each of the tubular bodies has bottom panels formed integrally therewith from that bottom flap hingedly connected to the respective one of the body side panels. Each of the tubular bodies is triangular in cross-section and a bottom panel of one of the tubular bodies is a matching triangular outline, and a bottom panel of the other of said tubular bodies being of a double triangular, diamond shape to underlie and close both tubular bodies.

Although the invention has been described above by reference to a preferred embodiment, it will be appreciated that other carton constructions may be devised, which are, nevertheless, within the scope and spirit of the invention and are defined by the claims appended thereto.

What is claimed is:

1. A carton structure including body side and end panels, bottom flaps connected to said body side panels along fold lines, and at least one top flap; and each of said body side panels, at least one of said body end panels, each of said bottom flaps, and said one top flap having lines of weakening therein for separating from said carton structure components of a caddy for pencils, crayons and the like, wherein said caddy includes two tubular bodies each formed from one of said body side panels, and each of said tubular bodies having bottom panels formed integrally therewith from that one of said bottom flaps hingedly connected to the respective one of said body side panels, and wherein each of said tubular bodies is triangular in cross-section, a bottom panel of one of said tubular bodies is of a matching triangular outline, and a bottom panel of the other of said tubular bodies is of a double triangular, diamond shape to underlie and close both tubular bodies.

2. A carton structure according to claim 1 wherein one bottom panel of one of said tubular bodies is of a size to extend below both tubular bodies.

3. A caddy for pencils, crayons and the like, said caddy comprising two tubular bodies fashioned from sheet material and having like panels in back to back relation, and receiving means securing said like panels together, wherein said securing means includes a combined divider and locking member, and like panels of said tubular bodies and said combined divider and locking member have cooperating slits therein for locking entry of said member into bottom portions of said tubular bodies.

4. A caddy according to claim 3 wherein each of said tubular bodies has bottom panels formed integrally therewith, one bottom panel of one of said tubular bodies being of a size to extend below both tubular bodies.

5. A caddy according to claim 3 wherein each of said tubular bodies is triangular in cross-section, a bottom panel of one of said tubular bodies being of a matching triangular outline, and a bottom panel of the other of said tubular bodies being of a double triangular, diamond shape to underlie and close both tubular bodies.

6. A caddy according to claim 3 wherein said securing means also includes a top locking member having a slit for locking engagement with said like panels of said tubular bodies remote from said combined divider and locking member.

7. A carton structure including body side and end panels, bottom flaps connected to said body side panels along fold lines, and at least one top flap; and each of said body side panels, at least one of said body end panels, each of said bottom flaps, and said one top flap having lines of weakening therein for separating from said carton structure components of a caddy for pencils, crayons and the like, wherein said caddy includes two tubular bodies each formed from one of said body side panels, and wherein each of said tubular bodies has a locking tab integrally hinged and connected to an edge thereof with said locking tab formed from said one body end panel.

8. A carton structure according to claim 7 wherein each of said tubular bodies is formed of substantially all of a respective one of said body side panels.

9. A carton structure according to claim 7 wherein each of said tubular bodies is formed of substantially all of a respective one of said body side panels, and each has a height and width corresponding to that of the respective body side panel.

10. A carton structure including body side and end panels, bottom flaps connected to said body side panels along fold lines, and at least one top flap; and each of said body side panels, at least one of said body end panels, each of said bottom flaps, and said one top flap having lines of weakening therein for separating from said carton structure components of a caddy for pencils, crayons and the like, and wherein said caddy includes two tubular bodies each formed from one of said body side panels, and wherein there is a combined divider and locking member formed from said one body end panel, and like panels of said tubular bodies and said combined divider and locking member have cooperating slits therein for locking entry of said member into bottom portions of said tubular bodies.

11. A carton structure according to claim 10 wherein said carton includes top locking flaps, each of said body end panels has a cut line arrangement therein defining a locking slot for one of said top locking flaps, and said cut line arrangement in said one body end panel defining a portion of the outline of said combined divider and locking member.

12. A carton structure according to claim 11 wherein said cut line arrangement also defines said slit in said combined divider and locking member.

13. A carton structure according to claim 10 wherein there is a locking member formed from said top flap and being provided with a slit for locking engagement with said like panels of said tubular bodies remote from said combined divider and locking member.

14. A carton structure including body side and end panels, bottom flaps connected to said body side panels along fold lines, and at least one top flap; and each of said body side panels, at least one of said body end panels, each of said bottom flaps, and said one top flap having lines of weakening therein for separating from said carton structure components of a caddy for pencils, crayons and the like, and wherein said caddy includes two tubular bodies each formed from one of said body side panels and includes a locking member formed from said top flap, said locking member provided with a slit for locking engagement with said tubular bodies.

* * * * *